United States Patent [19]

Kleijwegt

[11] Patent Number: 4,464,892

[45] Date of Patent: Aug. 14, 1984

[54] METALLIC CABLE FOR REINFORCING ELASTOMERIC ARTICLES

[75] Inventor: Jacob Kleijwegt, Arlon, Belgium

[73] Assignee: The Goodyear Tire & Rubber Company, Akron, Ohio

[21] Appl. No.: 474,399

[22] Filed: Mar. 11, 1983

[51] Int. Cl.[3] ..... D07B 1/00

[52] U.S. Cl. ..... 57/212

[58] Field of Search ..... 57/212, 213, 218, 219, 57/9, 902

[56] References Cited

U.S. PATENT DOCUMENTS

| | | | |
|---|---|---|---|
| 2,598,033 | 5/1952 | Bourdon | 57/212 |
| 2,609,653 | 9/1952 | Peterson | 57/213 X |
| 3,336,744 | 8/1967 | Peene | 57/213 X |
| 3,805,508 | 4/1974 | Maderna | 57/212 |
| 4,022,009 | 5/1977 | Assendelft | 57/212 |
| 4,030,248 | 6/1977 | Assendelft | 57/212 X |

*Primary Examiner*—Donald Watkins

*Attorney, Agent, or Firm*—L. R. Drayer

[57] ABSTRACT

A metallic cable for reinforcing elastomeric articles comprises a single strand of two filaments twisted together in a first direction, and a single filament helically disposed around the strand in a direction that is opposite to said first direction and has a pitch that is not greater than one and one-half times the lay length of said strand.

3 Claims, 22 Drawing Figures

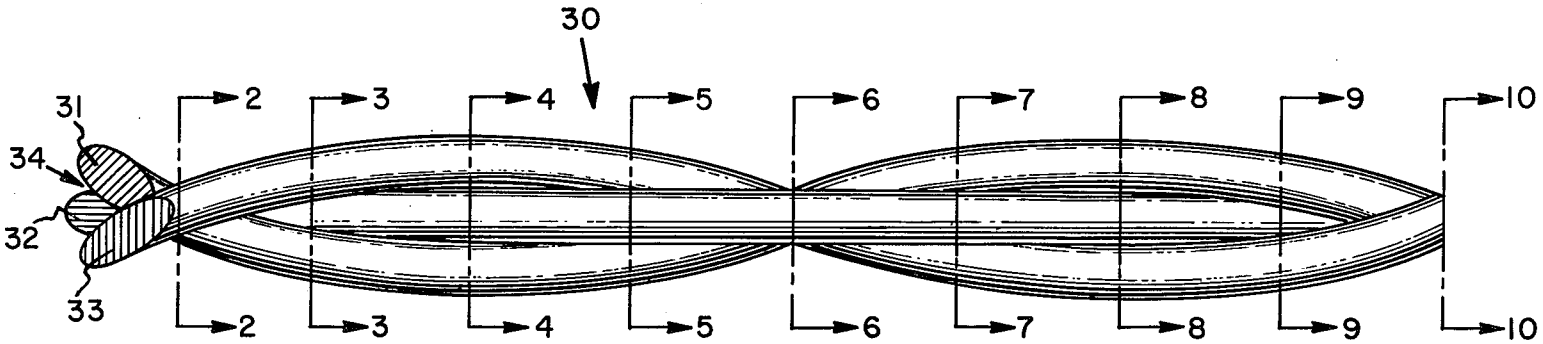
FIG. 1
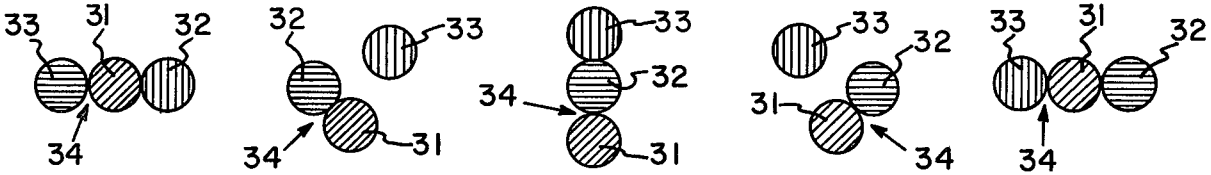
FIG. 2
FIG. 3
FIG. 4
FIG. 5
FIG. 6
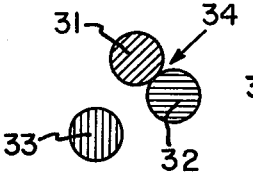
FIG. 7
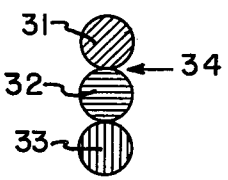
FIG. 8
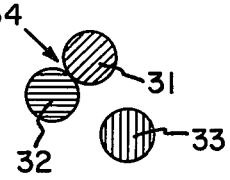
FIG. 9
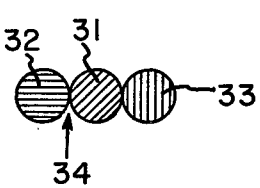
FIG. 10

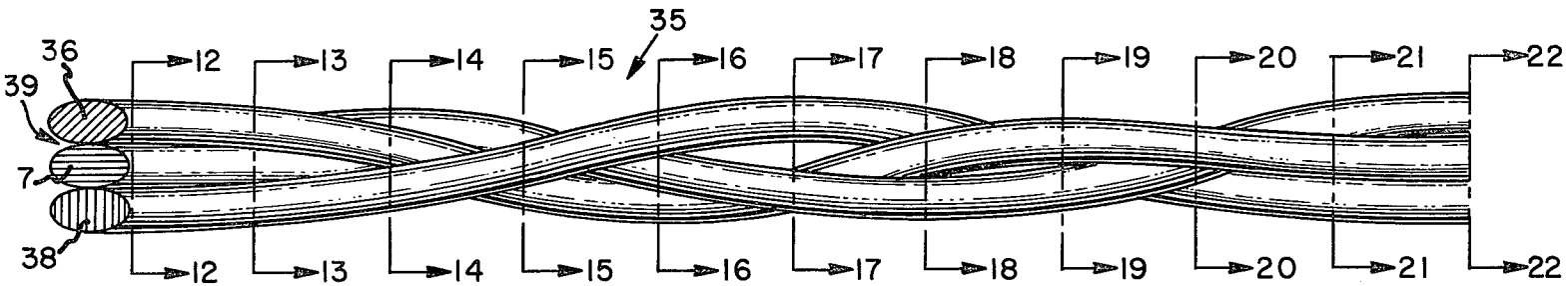
FIG.11
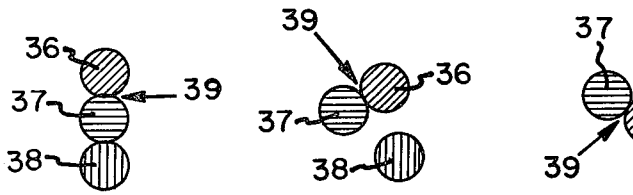
FIG.12
FIG.13
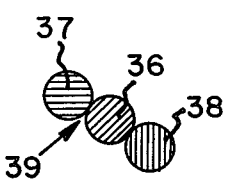
FIG.14
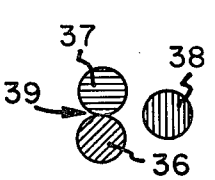
FIG.15
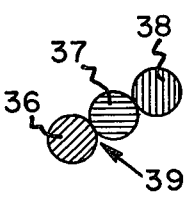
FIG.16
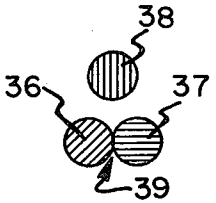
FIG.17
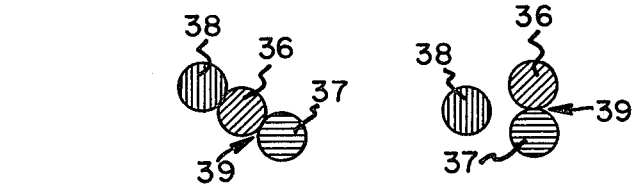
FIG.18
FIG.19
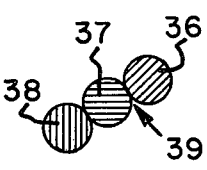
FIG.20
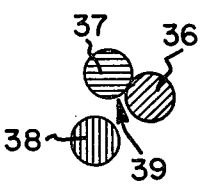
FIG.21
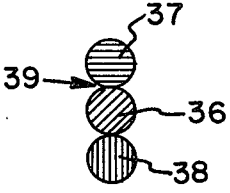
FIG.22

METALLIC CABLE FOR REINFORCING ELASTOMERIC ARTICLES

BACKGROUND OF THE INVENTION

This invention relates generally to metallic cables, and particularly to metallic cables that are useful for reinforcing elastomeric articles.

BRIEF DESCRIPTION OF THE DRAWING

The invention will be better understood by referring to the figures of the drawing, wherein:

FIG. 1 is a side elevation view of a cable made in accordance with one embodiment of the invention;

FIGS. 2 to 10 are cross-sectional views taken along lines 2—2 to 10—10, respectively, of FIG. 1;

FIG. 11 is a side elevation view of a cable made in accordance with another embodiment of the invention; and FIGS. 12 to 22 are cross-sectional views taken along lines 12—12 to 22—22, respectively, of FIG. 11.

DETAILED DESCRIPTION OF THE INVENTION

Referring first to FIG. 1, there is shown a side elevation view of a metallic cable 30 made in accordance with the preferred embodiment of the invention. The cable 30 comprises: (a) a single strand 34 of two filaments 31 and 32 twisted together in a first direction; and (b) a single filament 33 helically disposed around the strand 34 in a direction that is opposite to the direction of twist of the strand. The pitch of the helix formed by the single filament 33 is substantially the same as the lay length of the strand 34. Most preferably the helically disposed filament 33 is shifted one-half of its pitch length with respect to the strand 34. The diameter of the single filament 33 is equal to or greater than the diameter of the filaments 31,32 of the strand 34.

As used herein, a "filament" refers to an individual metallic wire; a "strand" refers to a group of filaments combined together to form a unit; and a "cable" refers to a structure comprised of two or more strands, or a combination of at least one strand with at least one filament.

Most prior art cables have wrap filaments whose main function is to keep the filaments of core strands in place, so that the contribution of the wrap filaments to the strength of the cable is minimal. Cable made in accordance with the preferred embodiment of the invention has a single filament helically disposed about a strand with substantially the same tensile strength and other physical properties as the filaments in the strand, a diameter that is equal to or larger than the diameter of the filaments of the strand, and a pitch length that is substantially the same as the lay length of the strand so that it is stressed at substantially the same level as the filaments of the strand. Therefore, the single filament that is helically disposed about the strand of two filaments to form a cable according to the invention makes a significant contribution to the strength of the cable that is substantially the same as the strength contributed by each filament of the strand.

Referring now to FIG. 11, there is shown a side elevational view of a metallic cable 35 made in accordance with another embodiment of the invention. The cable 35 shown in FIG. 11 is similar to the cable shown in FIG. 1, and comprises: (a) a single strand 39 of two filaments 36 and 37 twisted together in a first direction; and (b) a single filament 38 helically disposed around the strand 39 in a direction that is opposite to the direction of twist of the strand. In this embodiment, the pitch of the helix formed by the single wrap 38 is substantially one and one-half (1½) times the lay length of the strand 39. It is believed that the pitch of the helix formed by the single filament helically disposed around the single strand of a cable according to the invention should not be any greater than one and one-half (1½) times the lay length of the strand so that the helically disposed filament will not be stressed at a level that is excessively higher than the stress placed on the filaments of the strand due to the differential between the pitch and lay lengths.

As used herein, the direction of twist, lay, or a helix refers to the direction of slope of the spirals of a strand or filament when the cable is held vertically. If the slope of the spirals conform in direction to the slope of the letter "S", then the twist is called "S" or "left-hand." If the slope of the spirals conforms to the slope of the letter "Z," then the twist is called "Z" or "right-hand". "Lay length" is the axial distance required for a filament or strand to make one 360-degree revolution in a strand or cable. "Pitch length" is the axial distance required for a helically disposed filament to make one 360-degree revolution.

It is believed that an advantage of a cable made in accordance with the invention is an increased resistance to the spread of corrosion because an elastomeric material may easily penetrate between the single helically disposed filament and the single two filament strand.

FIGS. 2 to 10 are cross-sectional views taken along lines 2—2 to 10—10, respectively of FIG. 1 and FIGS. 12–22 are cross-sectional views taken along lines 12—12 to 22—22, respectively, of FIG. 11. The open structure of cables made in accordance with the invention, especially between the helically disposed filament and the strand, may be seen in these cross-sectional views.

This thorough coating of the strand and the single helically disposed filament with the elastomer not only helps to restrict the spread of corrosion but also contributes to the filament's resistance to wear against one another, and restricts the amount of heat generated when the cable is subjected to bending loads. For example, these advantages may be realized by using the cable to reinforce an elastomeric article such as a pneumatic tire or a belt.

While certain representative embodiments and details have been shown for the purpose of illustrating the invention, it will be apparent to those skilled in the art that various changes and modifications may be made therein without departing from the spirit or scope of the invention.

What is claimed is:

1. A metallic cable for reinforcing elastomeric articles comprising:

(a) a single strand of two filaments twisted together in a first direction; and (b) not more than one single filament helically disposed around said strand in a direction that is opposite to said first direction and has a pitch that is not greater than one and one-half times the lay length of said strand, said single filament having a diameter that is equal to or greater than the diameter of the filaments of said strand, said single filament having substantially the same physical properties as the filaments of said strand.

2. A metallic cable as described in claim 1, wherein the pitch of said single filament is substantially the same as the lay length of said strand.

3. A metallic cable as described in claim 2, wherein said single filament is shifted one-half of its pitch length with respect to said strand.

* * * * *